US010900504B2

(12) United States Patent
Boby et al.

(10) Patent No.: US 10,900,504 B2
(45) Date of Patent: Jan. 26, 2021

(54) HYDRAULIC APPARATUS AND HYDRAULIC APPLIANCE USABLE THEREIN

(71) Applicant: WESTINGHOUSE ELECTRIC COMPANY LLC, Cranberry Township, PA (US)

(72) Inventors: Dylan T. Boby, Trafford, PA (US); David J. Bubeck, Verona, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 712 days.

(21) Appl. No.: 14/985,770

(22) Filed: Dec. 31, 2015

(65) Prior Publication Data

US 2017/0191508 A1 Jul. 6, 2017

(51) Int. Cl.
*F15B 20/00* (2006.01)
*F01D 17/10* (2006.01)

(52) U.S. Cl.
CPC ..... *F15B 20/004* (2013.01); *F01D 17/10* (2013.01); *F15B 20/008* (2013.01); *F15B 2211/30505* (2013.01); *F15B 2211/30565* (2013.01); *F15B 2211/31582* (2013.01); *F15B 2211/40592* (2013.01); *F15B 2211/411* (2013.01); *F15B 2211/41527* (2013.01); *F15B 2211/8755* (2013.01); *F15B 2211/8757* (2013.01)

(58) Field of Classification Search
CPC ..... F15B 20/00; F15B 20/004; F15B 20/008; F15B 11/055; F15B 11/0423; F15B 2211/40584; F15B 2211/3057; F15B 2211/3058; F15B 2211/40592
See application file for complete search history.

(56) References Cited

U.S. PATENT DOCUMENTS 6,715,402 B2 * 4/2004 Pfaff ..... F15B 11/006 91/526
7,634,911 B2 * 12/2009 Brinkman ..... E02F 9/2075 60/414
2010/0104439 A1 4/2010 Nomaguchi et al.
(Continued)

FOREIGN PATENT DOCUMENTS

DE 102011012305 A1 8/2012
EP 2650549 A2 10/2013
EP 2667038 A1 11/2013
(Continued)

OTHER PUBLICATIONS

PCT/US2016/061949, International Search Report and Written Opinion, dated Feb. 23, 2017, 9 pages.
Extended European Search Report, dated Jul. 31, 2019, 7 pages.

*Primary Examiner* — Nathaniel E Wiehe
*Assistant Examiner* — Michael Quandt
(74) *Attorney, Agent, or Firm* — K&L Gates LLP

(57) ABSTRACT

A hydraulic apparatus includes a first valve manifold that provides a shutdown capability and a second valve manifold that provides an overspeed control capability. The hydraulic apparatus advantageously further employs a hydraulic appliance that includes a check valve and a bypass apparatus. The hydraulic appliance enables the second valve manifold to additionally provide as an alternative function a redundant shutdown capability, thereby obviating the need to have three separate valve manifolds.

4 Claims, 5 Drawing Sheets

(56) References Cited

U.S. PATENT DOCUMENTS

| | | | |
|---|---|---|---|
| 2011/0030364 | A1 | 2/2011 | Persson et al. |
| 2013/0125539 | A1 | 5/2013 | Kobayashi et al. |

FOREIGN PATENT DOCUMENTS

| | | | |
|---|---|---|---|
| EP | 2667038 | A2 | 11/2013 |
| JP | 2003056306 | A | 2/2003 |
| WO | 2014193649 | A1 | 12/2014 |
| WO | 2015185607 | A1 | 12/2015 |
| WO | 2015186607 | A1 | 12/2015 |
| WO | 2017116573 | A1 | 7/2017 |

* cited by examiner

HYDRAULIC APPARATUS AND HYDRAULIC APPLIANCE USABLE THEREIN

BACKGROUND

1. Field

The disclosed and claimed concept relates generally to hydraulic equipment and, more particularly, to a hydraulic apparatus that is usable to control the supply of hydraulic fluid to a device to control at least one aspect of the operation of the device.

2. Related Art

Hydraulic systems are well known in the related art to do many things and most particularly perform useful work. In some systems, electrically controlled valves control the flow of pressurized hydraulic fluid to another location within a hydraulic circuit to perform the useful work. Hydraulic systems typically include a pressurized supply line that is in fluid communication with the device that performs the useful work and typically further includes a return line that returns reduced pressure hydraulic fluid to a reservoir. In some circumstances, and depending upon the valving that is employed, the supply and return lines can be provided by a single line. Hydraulic systems may additionally include another line that can be referred to as a bypass line or a return line that returns excess hydraulic fluid to the reservoir in order to maintain a predetermined hydraulic pressure in the supply line and for other purposes.

In certain applications, the hydraulic system or a device that is operated by the hydraulic system is of such importance that redundancy is built into the system such that if a given hydraulic component or circuit fails another hydraulic component or circuit can be tasked to perform the needed functions until the failed componentry is repaired or replaced. An example of such redundancy being required is in the environment of a fossil or nuclear power plant of the type that generates steam which operates a steam turbine connected with an electrical generator. The valves that supply such steam to the turbine are controlled by valves that are biased to the closed position, and the hydraulic pressure is employed to overcome the bias and open the valves to thereby supply steam to the turbine. A loss of hydraulic pressure will cause the supply valves to become closed, thereby operating as something of a fail-safe system. The ability to relieve such hydraulic pressure as needed in such an application is sufficiently great that previously known systems have employed both a primary shutdown circuit as well as a backup shutdown circuit. That way, if the primary shutdown circuit somehow failed, the backup shutdown circuit could be operated to cease the flow of steam to the turbine and to take the turbine offline in order to avoid damage to the turbine, the generator, or other componentry. While such systems have been generally effective for their intended purposes, they have not been without limitation.

In the aforementioned example of a steam turbine that is connected with an electrical generator, the hydraulic control circuitry has typically additionally included a third hydraulic control system that would handle an overspeed condition by temporarily reducing or eliminating the flow of steam to the turbine. For instance, the turbine typically would operate at 1800 RPMs in order to generate electricity having 60 Hz, but if the turbine rotational speed exceeded 1800 RPMs, the generated electricity would have a frequency in excess of 60 Hz, which is undesirable. In such a situation, the overspeed hydraulic control would slow or cease the flow of steam to the turbine to permit the turbine to coast back down to 1800 RPMs, at which point the supply of steam to the turbine would be returned or increased to maintain operation at 1800 RPMs. However, the magnitude and complexity of such a hydraulic control system and the cost thereof has become excessive. In some situations, solenoid-operated valves have been replaced with valve manifold blocks that each employ a plurality of valves that are operated simultaneously and are configured such that the system will operate properly (i.e., control is adequately provided) if a certain number of valves from among all of the valves in the manifold operate properly. For example, some valve manifold blocks have employed three valves, and the system is designed to operate properly if two of the three valves function in response to an input. As such, if one of the valves is stuck in an open condition, the loss of fluid to that valve would not be sufficiently great to hamper operation of the connected hydraulic system. Similarly, if one of the three valves was stuck in a closed position, the other two valves operated to the open position could properly and adequately perform the necessary function. Numerous examples exist of such systems wherein a plurality of parallel valves are configured such that fewer than all of them being operational will still permit proper operation of the connected hydraulic circuit.

Nevertheless, the cost of such hydraulic systems employing valve manifold block has become excessive, particularly when more than one such system is required for redundancy, and if further valving or other control is required in addition for the purpose of overspeed control, by way of example. As mentioned above, the cost of such componentry is only one element in the overall calculation of cost because another expense is encountered in the complex piping and connections that are required to implement such systems, and further expense is encountered simply by virtue of the significant volume of space that is occupied such systems. Improvements thus would be desirable.

SUMMARY

A hydraulic apparatus includes a first valve manifold that provides a shutdown capability and a second valve manifold that provides an overspeed control capability. The hydraulic apparatus advantageously further employs a hydraulic appliance that includes a check valve and a bypass apparatus. The hydraulic appliance enables the second valve manifold to additionally provide as an alternative function a redundant shutdown capability, thereby obviating the need to have three separate valve manifolds.

Accordingly, an aspect of the disclosed and claimed concept is to provide an improved hydraulic apparatus that employs a bypass apparatus to enable a set of valves to perform both a primary function and a secondary redundant function to reduce cost and complexity.

Another aspect of the disclosed and claimed concept is to provide an improved hydraulic apparatus that employs a bypass apparatus that is far less costly than a valve manifold in order to provide three hydraulic operations, such as shutdown, speed control, and redundant shutdown, with only two valve manifolds.

Another aspect of the disclosed and claimed concept is to reduce the complexity and cost of a hydraulic apparatus.

Another aspect of the disclosed and claimed concept is to provide an improved hydraulic appliance that can be used in implementing an improved hydraulic apparatus wherein the hydraulic appliance costs less than a valve manifold and occupies less space and requires fewer hydraulic connections.

Accordingly, an aspect of the disclosed and claimed concept is to provide an improved hydraulic apparatus that is structured to manage the supplying of hydraulic fluid to a device to thereby control at least one aspect of the operation of the device. The hydraulic apparatus can be generally stated as including a first control leg structured to be connected in fluid communication with the device, a second control leg structured to be connected in fluid communication with the device, a check valve that is connected in fluid communication between the first control leg and the second control leg, the check valve resisting hydraulic fluid flow in a direction from the first control leg toward the second control leg and permitting hydraulic fluid flow in a direction from the second control leg toward the first control leg, a bypass apparatus that is connected in fluid communication between the first control leg and the second control leg and that is connected in parallel with the check valve, the bypass apparatus being operable between a first state and a second state, the bypass apparatus in the first state resisting hydraulic fluid flow between the first and second control legs, the bypass apparatus in the second state permitting hydraulic fluid flow between the first and second control legs, a number of first valves connected in fluid communication with the first control leg, the number of first valves further being connected in fluid communication with a supply of hydraulic fluid that is at an increased pressure and with a drain that is at a reduced pressure, the number of first valves being operable between a first state and a second state. As employed herein, the expression "a number of" and variations thereof shall refer broadly to any non-zero quantity, including a quantity of one. In the first state of the number of first valves and the first state of the bypass apparatus, the first control leg being in fluid communication with the supply. In the second state of the number of first valves and the first state of the bypass apparatus, the first control leg being in fluid communication with the drain, and the second control leg via the check valve being in fluid communication with the drain. In the first state of the number of first valves and the second state of the bypass apparatus, the first control leg being in fluid communication with the supply and being in fluid communication with the second control leg via the bypass apparatus. In the second state of the number of first valves and the second state of the bypass apparatus, the first control leg being in fluid communication with the drain, and the second control leg via the check valve and the bypass apparatus being in fluid communication with the drain. The hydraulic apparatus can be generally stated as further including a number of second valves connected in fluid communication with the second control leg, the supply, and the drain, the number of second valves being operable between a first state and a second state. In the first state of the number of second valves and the first state of the bypass apparatus, the second control leg being in fluid communication with the supply. In the second state of the number of second valves and the first state of the bypass apparatus, the second control leg being in fluid communication with the drain. In the first state of the number of second valves and the second state of the bypass apparatus, the second control leg being in fluid communication with the supply and being in fluid communication with the first control leg via the bypass apparatus. In the second state of the number of second valves when the bypass apparatus is in the second state, the second control leg being in fluid communication with the drain, and the first control leg being in fluid communication via the bypass apparatus with the drain.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
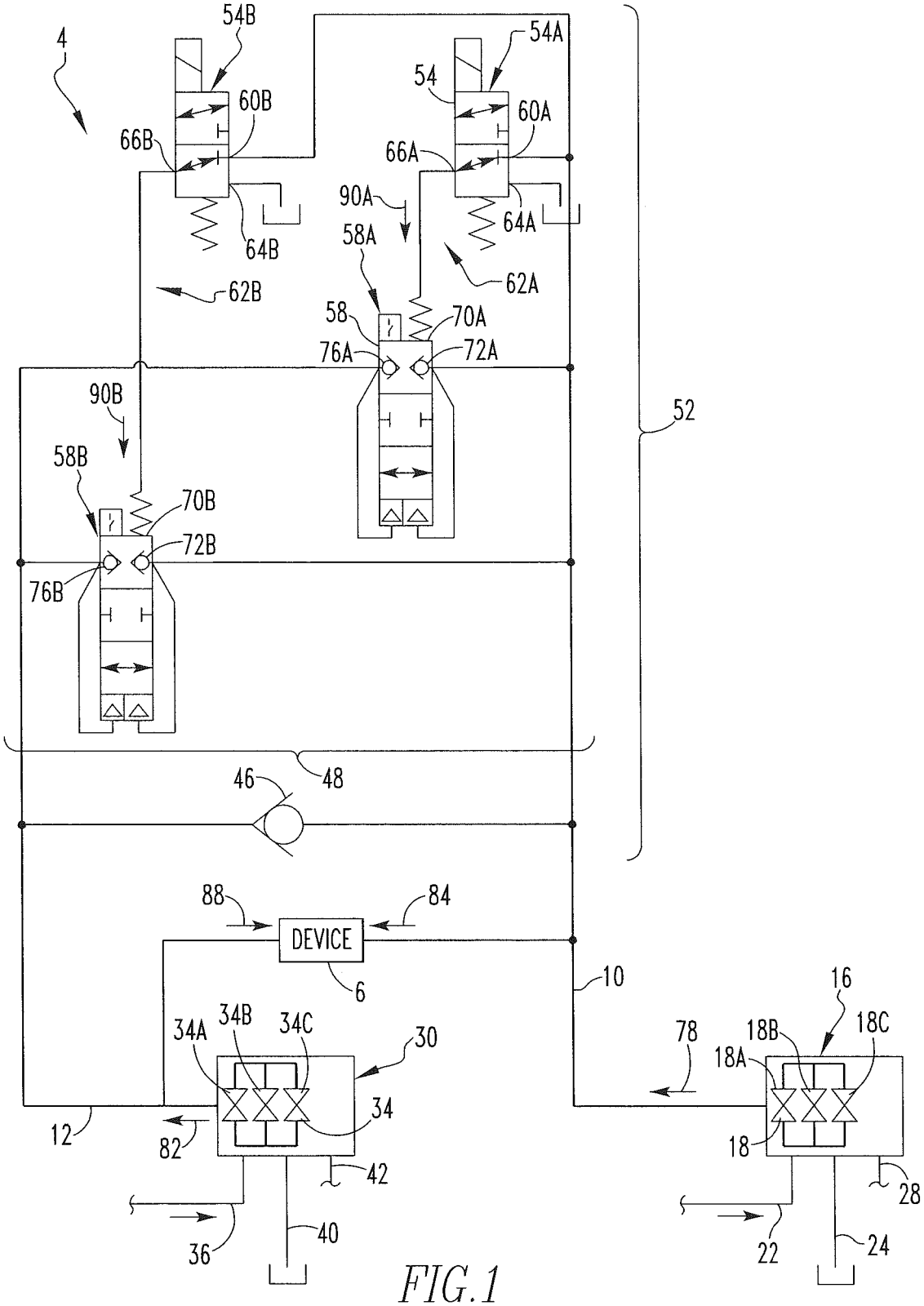
FIG. 1 is a diagram of an improved hydraulic apparatus in accordance with the disclosed and claimed concept controlling the flow of hydraulic fluid to a device to control at least one aspect of the operation of the device.

An improved hydraulic apparatus 4 is depicted in FIGS. 1-4. The hydraulic apparatus 4 is operable to control the flow of hydraulic fluid to a device 6 that is connected therewith in order to control at least one aspect of the operation of the device 6. In the depicted exemplary embodiment, the device 6 is a steam turbine that is operatively connected with an electrical generator, and the supply of hydraulic fluid to the device 6 by the hydraulic apparatus 4 operates valves that control the supply of steam to the turbine. It is understood, however, that other types of machinery and the like can be controlled by the hydraulic apparatus 4 without departing from the present concept.

The hydraulic apparatus 4 can be said to include a first control leg 10 that is in fluid communication with the device 6 and to further include a second control leg 12 that is likewise in fluid communication with the device 6. The supply of hydraulic fluid to the device 6 by the first and second control legs 10 and 12 controls the operations of valves on the device that control the supply of steam to the device 6. The hydraulic apparatus 4 further includes a first valve manifold 16 that is in fluid communication with the first control leg 10 and a second valve manifold 30 that is in fluid communication with the second control leg 12. As will be set forth in greater detail below, the first and second valve manifolds 16 and 30 each include a plurality of valves that are connected in fluid communication in parallel with one another and are simultaneously operated by an operating mechanism therein. Moreover, the first and second valve manifolds 16 and 30 are each configured to enable proper operation thereof (i.e., achievement of its intended function) with fewer than all of the valves operating in response to a command. It is understood that in other embodiments the first and second valve manifolds 16 and 30 can be in the form of other valve systems without departing from the present concept.

The first valve manifold 16 includes three first valves that are indicated at the numerals 18A, 18B, and 18C, and which can be collectively or individually referred to herein with the numeral 18. The first valves 18 are connected in fluid communication in parallel with one another and are simultaneously operable between a first state and a second state. The first valve manifold 16 has connected in fluid communication therewith a first supply 22, a first drain 24, and a first return 28. The first supply 22 is a supply of pressurized hydraulic fluid that is placed in fluid communication with the first control leg 10 when the first valve manifold 16 is in the first state such as is depicted in FIG. 1. The first valve manifold 16 is operable between the first state, which is depicted generally in FIGS. 1 and 2, and the second state, which is depicted generally in FIGS. 3 and 3A, wherein the first control leg 10 is placed in fluid communication with the first drain 24. In the second state of the first valve manifold 16, the first supply 22 can be connected in fluid communication with the first return 28 to return the supply of pressurized hydraulic fluid from the first supply 22 back to a reservoir that supplies the first supply 22. Alternatively, in the second state of the first valve manifold 16 the first supply 22 can be connected in fluid communication with the first drain 24 to return the pressurized hydraulic fluid from the first supply 22 to a reservoir that supplies hydraulic fluid to the first supply 22. It is also possible that the first return 28 can be in fluid communication with the first supply 22 in the first state of the first valve manifold 16 in order to return excess hydraulic fluid to a reservoir if the first supply 22 is at a hydraulic pressure in excess of what would be desired for supply to the first control leg 10.

Figure 2:
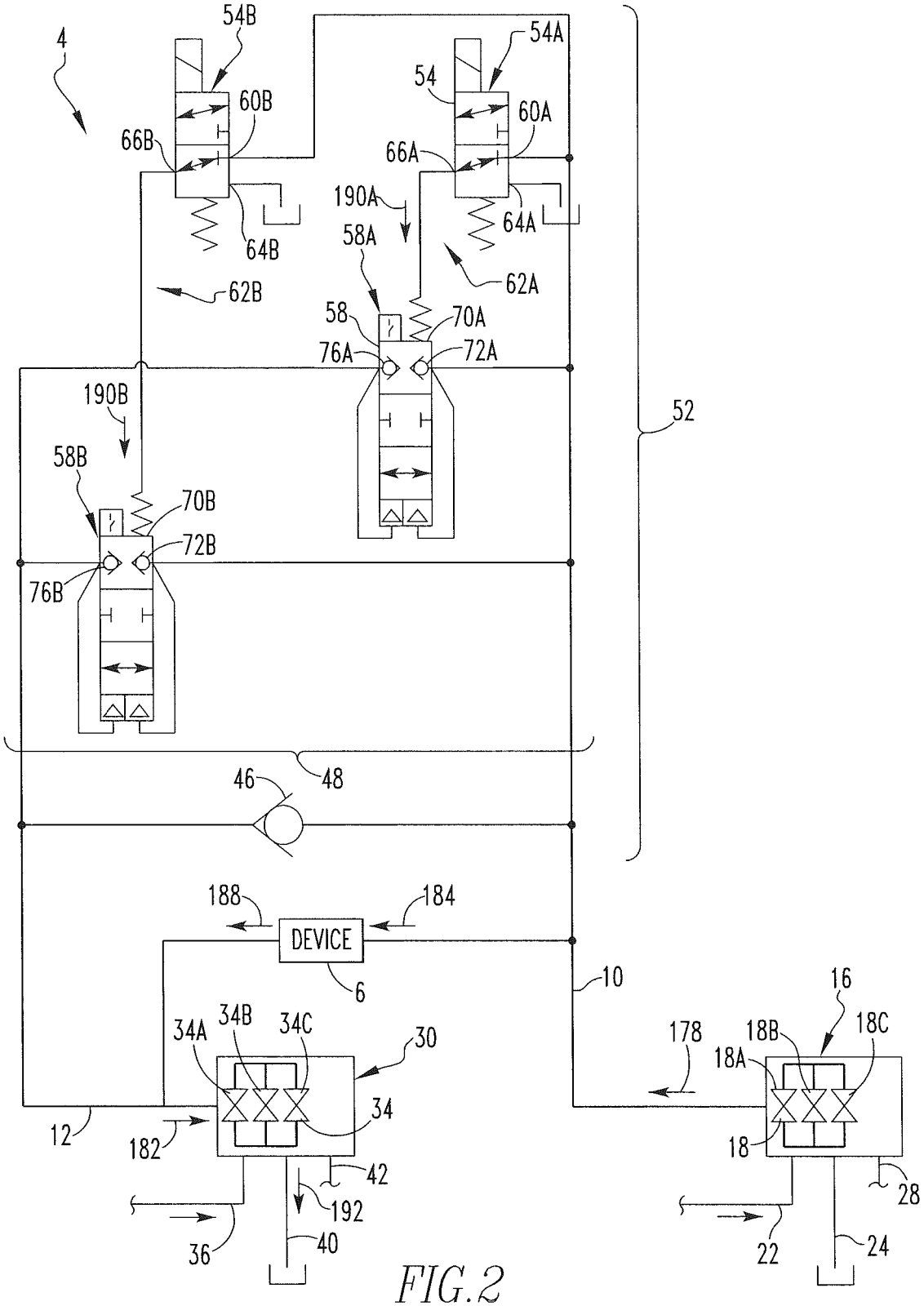
FIG. 2 is a view similar to FIG. 1, except depicting a primary control operation.
Figure 3:
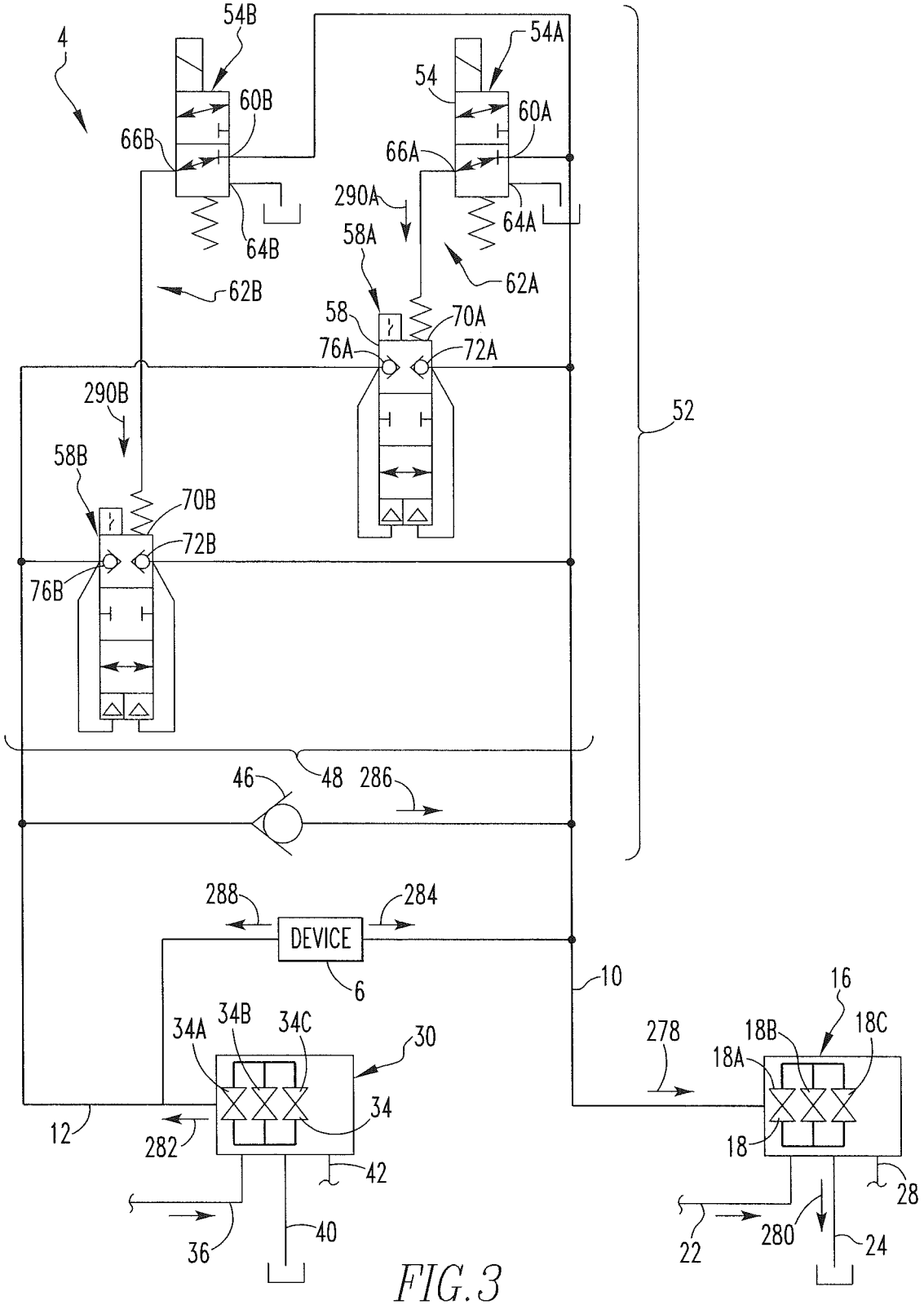
FIG. 3 is a view similar to FIG. 2, except depicting another primary control operation.
Figure 3A:
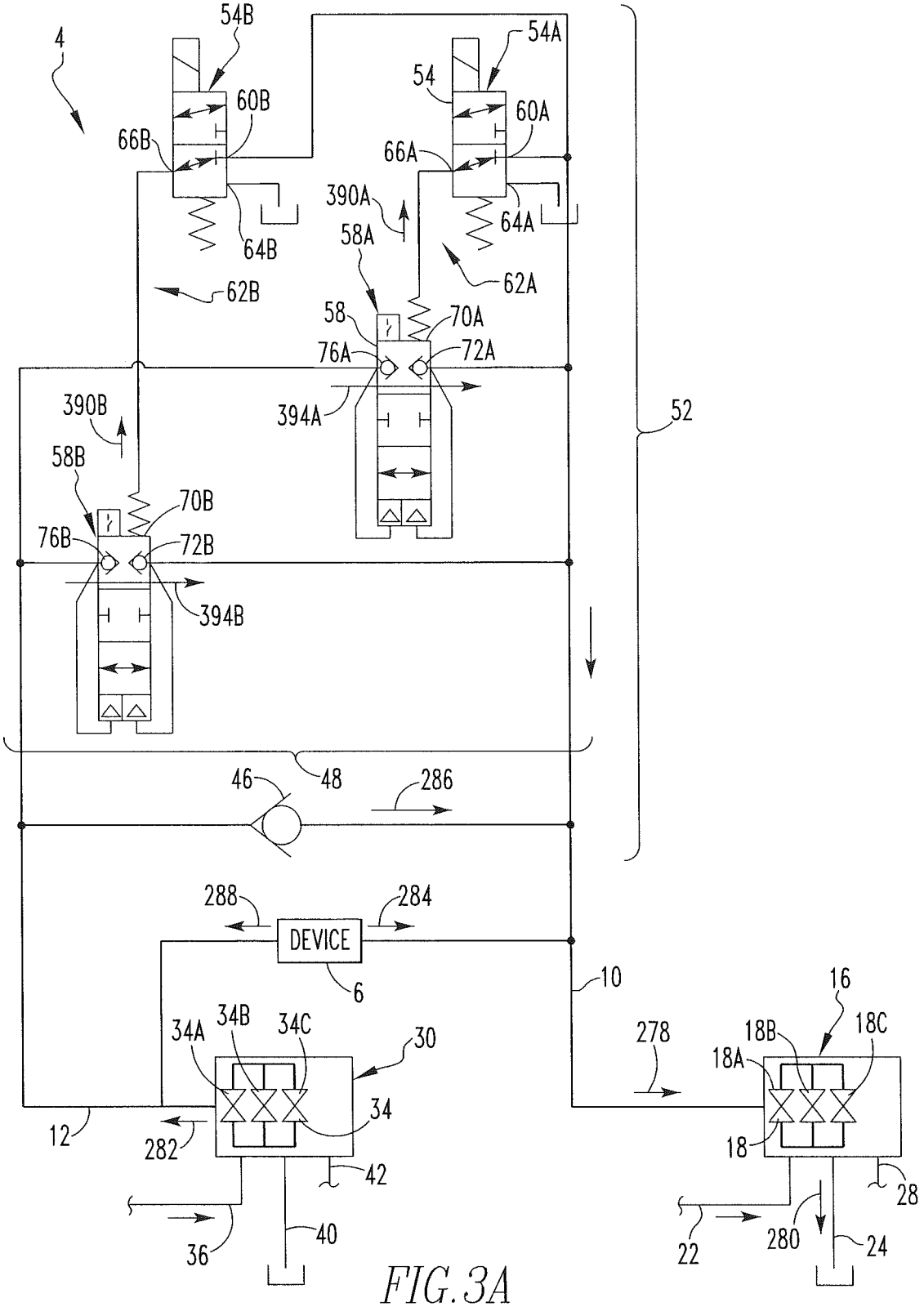
FIG. 3A is a view similar to FIG. 3, except depicting another aspect of the another primary control operation.
Figure 4:
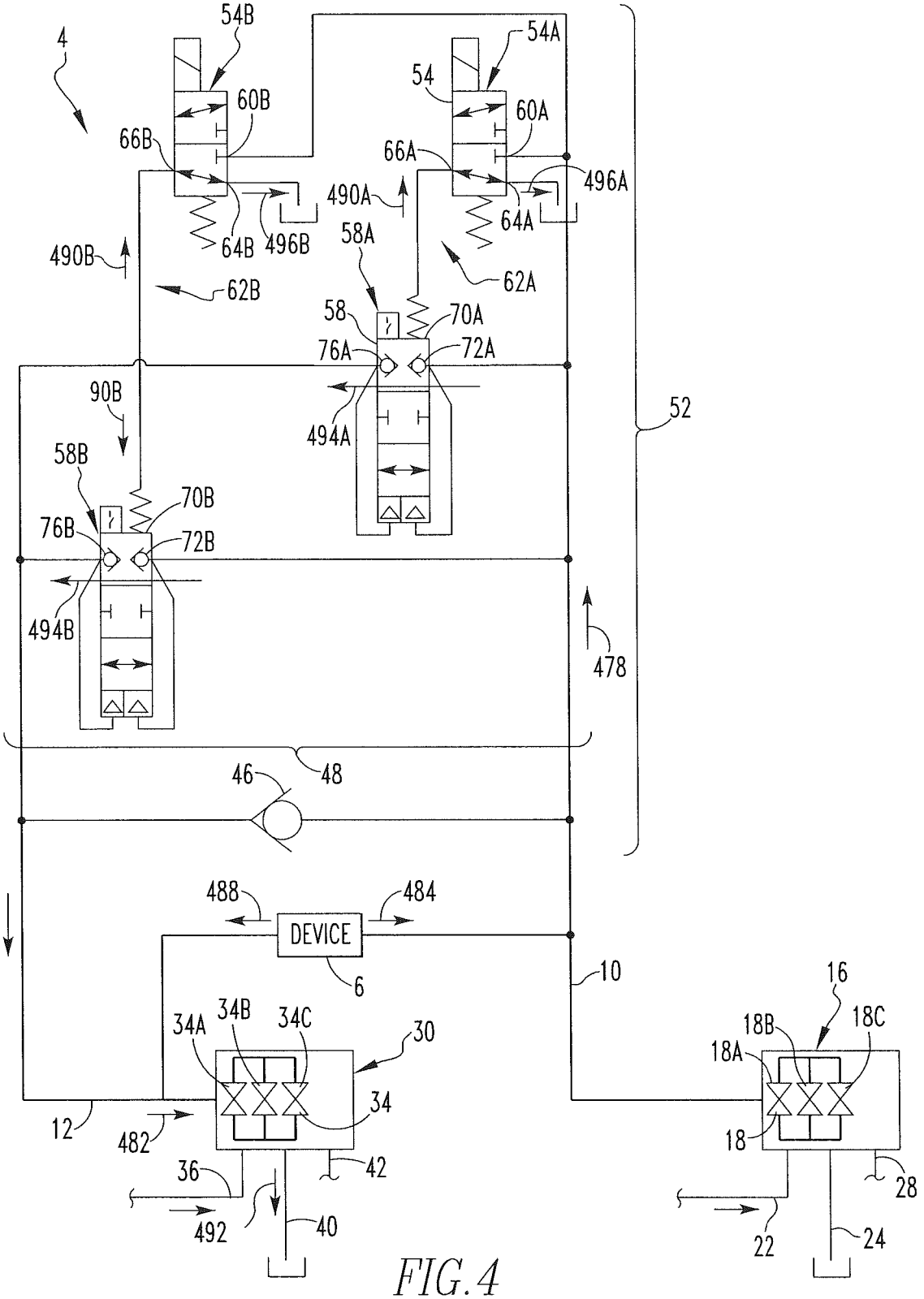
FIG. 4 is a view similar to FIG. 1, except depicting a secondary control operation that is a redundant control operation.

The second valve manifold 30 is similar to the first valve manifold 16 and includes three second valves that are indicated at the numerals 34A, 34B, and 34C, and that can be collectively or individually referred to herein with the numeral 34. The second valves 34 are connected in fluid communication parallel with one another and are simultaneously operable by a control system between a first state and a second state. The second valve manifold 30 has a second supply 36, a second drain 40, and a second return 42 connected in fluid communication therewith, in a fashion similar to the first valve manifold 16. In the first state of the second valve manifold 30, which is depicted in FIGS. 1, 3, and 3A, the second supply 36 is connected in fluid communication with the second control leg 12. In the second state of the second valve manifold 30, which is depicted in FIGS. 2 and 4, the second control leg 12 is connected in fluid communication with the second drain 40. The second drain 40 and the second return 42 are in fluid communication with a reservoir that supplies the second supply 36 and/or the first supply 22. As a general matter, it is understood that the first and second supplies 22 and 36 are likely obtained from a single source of pressurized hydraulic fluid that is fed by a single reservoir of hydraulic fluid to which all of the flows of the hydraulic apparatus 4 return, although this need necessarily be the case depending upon the needs of the particular application.

The hydraulic apparatus 4 further includes a check valve 46 that is connected in fluid communication between the first control leg 10 and the second control leg 12. The check valve 46 permits fluid flow across it from the second control leg 12 to the first control leg 10 but resist any such flow in the opposite direction across it.

The hydraulic apparatus 4 further includes a bypass apparatus 48 that is likewise connected in fluid communication with the first and second control legs 10 and 12 and which can be said to be in parallel with the check valve 46. As will be set forth in greater detail below, and depending upon various circumstances, the bypass apparatus 48 can permit the flow of hydraulic fluid from the first control leg 10 to the second control leg 12 and also from the second control leg 12 to the first control leg 10 in a fashion bypassing the check valve 46.

The check valve 46 and the bypass apparatus 48 can together be considered to form a hydraulic appliance 52 that is connected in fluid communication with the first control leg 10 and the second control leg 12. As will be set forth in greater detail below, the hydraulic appliance 52 is far less costly than either of the first and second valve manifolds 16 and 30. As will further be set forth in greater detail below, the bypass apparatus 48 enables the second valve manifold 30 to perform two functions rather than simply performing a single function, which advantageously reduces the cost of the hydraulic apparatus 4.

The bypass apparatus 48 can be said to include a pair of solenoid valves that are indicated at the numerals 54A and 54B and which may be collectively or individually referred to herein with the numeral 54. The bypass apparatus 48 further includes a pair of poppet logic valves that are indicated at the numerals 58A and 58B and which may be collectively or individually referred to herein with the numeral 58. Each solenoid valve 54 is connected in fluid communication with a corresponding one of the poppet valves 58. The combined solenoid valve 54A and poppet logic valve 58A can be said to together form a first valve combination 62A, and the combined solenoid valve 54B and poppet logic valve 58B can be said to together form a second valve combination 62B. The first and second valve combinations 62A and 62B are connected in fluid communication with the first and second control legs 10 and 12 in parallel with one another in order to serve as fluid connection devices that are redundant to one another.

The solenoid valve 54A has three connections that are indicated generally at the numerals 60A, 64A, and 66A. The solenoid valve 54B likewise has three connections that are indicated at the numerals 60B, 64B, and 66B. The connections 60A and 60B are connected in fluid communication with the first control leg 10, and the connections 64A and 64B are connected in fluid communication with a drain or reservoir of hydraulic fluid. The connections 66A and 66B are connected in fluid communication with the poppet logic valves 58A and 58B, respectively. More specifically, the poppet logic valves 58A and 58B each have a control connection 70A and 70B, respectively, that are connected in fluid communication with the connections 66A and 66B, respectively. The poppet logic valves 58A and 58B further have a first valve 72A and 72B, respectively, that is connected in fluid communication with the first control leg 10. The poppet logic valves 58A and 58B each additionally include a second valve 76A and 76B, respectively, that is connected in fluid communication with the second control leg 12.

A control system controls the operation of the first and second valve manifolds 16 and 30 and the operation of the solenoid valves 54. When the solenoid valves 54 are energized by the control system, they are in a first state such as is depicted generally in FIGS. 1-3A wherein the connections 60A and 60B are in fluid communication with the connections 66A and 66B, respectively. When the solenoid valves 54 are de-energized by the control system, the solenoid valves 54 switch to a second state such as is depicted in FIG. 4 wherein the connections 66A and 66B are in fluid communication with the connections 64A and 64B, respectively. When a predetermined hydraulic pressure is applied to the control connections 70A and 70B, the first and second valves 72A, 76A, 72B, and 76B are in a closed state and resist fluid flow through the poppet logic valves 58 between the first and second control legs 10 and 12. Such a predetermined hydraulic pressure is provided by the first control leg 10 when the first valve manifold 16 is in its first state and when the solenoid valves 54 are in their first state, as is depicted generally in FIG. 1. However, if the hydraulic pressure at the control connections 70A and 70B drops below a predetermined threshold, the poppet logic valves 58 will change to an open state and will begin to permit fluid flow between the first and second control legs 10 and 12 in either direction. When such fluid flow is permitted by the poppet logic valves 58 between the first and second control legs 10 and 12, fluid flow through the poppet logic valves 58 from the first control leg 10 to the second control leg 12 experiences a greater pressure drop than when flowing through the poppet logic valves 58 from the second control 12 to the first control leg 10.

As mentioned above, FIG. 1 depicts the first and second valve manifolds 16 and 30 in their first state. In such a condition, fluid pressure is applied to the first control leg 10, as is indicated with the arrow 78, which correspondingly results in hydraulic pressure being applied to the device 6 from the first control leg 10, as is indicated at the arrow 84. Likewise, hydraulic fluid pressure is applied by the second valve manifold 30 to the second control leg 12, as is indicated with the arrow 82, which correspondingly results in hydraulic pressure being applied to the device 6 from the second control leg 12, as is indicated at the arrow 88. Since the hydraulic pressure is applied to the second control leg 12, as is indicated at the arrow 82, and since the energized solenoid valves 54 are in their first state, the hydraulic pressure in the first control leg 10 is applied through the connections 60A and 66A to the control connection 70A, as is indicated at the arrow 90A, and through the connections 60B and 66B to the control connection 70B, as is indicated at the arrow 90B, to keep the poppet logic valves 58 in their closed state resisting flow of hydraulic fluid across them.

FIG. 2 depicts the second valve manifold 30 having changed from its first state (that was depicted in FIG. 1) to its second state wherein the second control leg 12 is in fluid communication with the second drain 40. As such, hydraulic fluid in the second control leg 12 flows in the direction of the arrow 182 from the second control leg 12 into the second valve manifold 30, and thereafter to the second drain 40 as is indicated with the arrow 192. Such drainage results in a flow of hydraulic fluid away from the device 6 and into the second control leg 12, as is indicated at the arrow 188. Since the check valve 46 resists the flow therethrough of hydraulic fluid from the first control leg 10 toward the second control leg 12, and since the first valve manifold 16 remains in its first state, hydraulic pressure continues to be delivered to the first control leg 10, as is indicated at the numeral 178, which continues to provide hydraulic pressure to the device 6 as is indicated at the arrow 184. Likewise, the continued hydraulic pressure in the first control leg 10 with the solenoid valves 54 in their first state continues to apply pressure to the control connections 70A and 70B, as is indicated at the arrows 190A and 190B. The poppet logic valves 58 thus remain in their closed state resisting fluid flow therethrough. In the scenario depicted generally in FIG. 2, therefore, the second valve manifold 30 performs its primary function which, in the depicted exemplary embodiment, is overspeed control of the device 6.

FIG. 3 depicts a scenario wherein the first valve manifold 16 is instructed by the control system to perform its protective function by moving from the first state depicted generally in FIGS. 1 and 2 to the second state that is depicted in FIG. 3. In such a situation, the first control leg 10 is placed in fluid communication with the first drain 24 such that the first control leg 10 is drained. That is, hydraulic fluid flows from the device 6, as is indicated generally at the arrow 284, and into the first control leg 10, after which it flows, as is indicated the arrow 278, into the first valve manifold 16 and through the first drain 24, as is indicated at the arrow 280. Since the first control leg 10 is at a reduced hydraulic pressure in such a situation, hydraulic fluid flows from the pressurized second control leg 10 across the check valve 46, as is indicated at the arrow 286, and into the first control leg 10. This results in draining of the second control leg 12. Such drainage results in a flow of hydraulic fluid away from the device 6 and into the second control leg 12, as is indicated at the arrow 288. Such hydraulic flow at the arrow 288 and the pressurized hydraulic flow from the first supply 36 flow through the second control leg 12, as is indicated at the arrow 282, and across the check valve 46, as is indicated at the arrow 286.

It thus can be seen that placing the first valve manifold 16 in its second state reduces or removes hydraulic pressure to the device 6 from the first control leg 10 by causing a flow of hydraulic fluid away from the device 6, as is indicated at the arrow 284. At least initially, and as mentioned above, the check valve 46 permits the second control leg 12 to be drained through the first control leg 10 and into the first drain 24 since the check valve 46 permits the flow of hydraulic fluid from the second control leg 12 to the first control leg 16 but not vice versa. As can be seen in FIG. 3A, however, once the hydraulic pressure on the first control leg 10 drops to a predetermined threshold, the hydraulic pressure applied at the control connections 70A and 70B becomes reduced, and hydraulic fluid begins to flow, as is indicated at the arrows 390A and 390B, respectively, from the control connections 70A and 70B through the solenoid valves 54 in their energized first state and into the first control leg 10 and out of the first drain 24. Such a drop in pressure at the control connections 70A and 70B to the predetermined threshold places the poppet logic valves 58 in their open state, which permits a flow across the poppet logic valves 58 from the second control leg 12 to the first control leg 10, as is indicated at the arrows 394A and 394B. The flows 394A and 394B are in addition to the flow from the second control leg 12 to the first control leg 10 across the check valve 46 that is indicated with the arrow 286. As such, the configuration of the bypass apparatus 48 advantageously provides an additional path outside of the check valve 46 for the second control leg 12 to drain the hydraulic fluid away from the device 6 as is indicated at the arrow 288.

As is depicted generally in FIG. 4, the bypass apparatus 48 can be de-energized by the control system or otherwise to advantageously cause the solenoid valves 54 to change to their second state to enable the second valve manifold 30 to additionally perform a secondary function, which happens to be a redundant function for that of the first valve manifold 16, i.e., a shutdown of the device 6. When the solenoid valves 54 to move from the first state to the second state by being de-energized, hydraulic fluid flows from the control connections 70A and 70B, as is indicated at the arrows 490A and 490B, into the connections 66A and 66B, respectively, and out of the connections 64A and 64B, respectively, as is indicated at the arrows 496A and 496B, to a drain or other reservoir that feeds the first and/or second supplies 22 and 36. If, in such a situation, the control system instructs the second valve manifold 30 to move to its second state, as is depicted in FIG. 4, the second control leg 12 is placed in fluid communication with the second drain 40, which will cause the hydraulic fluid in the second control leg 12 to drain, as at the arrow 482, into the second valve manifold 30, and then out of the second valve manifold 30 and to the second drain 40, as is indicated at the arrow 492. Such a draining of the second control leg 12 will likewise result in a flow of hydraulic fluid away from the device 6 and into the second control leg 12, as is indicated at the arrow 488, for drainage to the second drain 40.

However, since (as noted above) the poppet logic valves 58 will have been placed in their open state, this will permit hydraulic fluid to flow across the poppet logic valves 58, as is indicated at the arrows 494A and 494B, from the first control leg 10 to the second control leg 12. Such flows 494A and 494B will cause the first control leg 10 to be drained into the second control leg 12, thereby causing hydraulic fluid to flow away from the device 6, as is indicated at the arrow 484 and at the arrow 478. Such a flow from the first control leg 10, as is indicated at the arrow 478, and across the poppet logic valves 58, as is indicated at the arrows 494A and 494B, constitutes a bypassing of the check valve 46 because it permits hydraulic fluid to flow from the first control leg 10 to the second control leg 12, which would be prohibited by the check valve 46 itself.

The scenario depicted in FIG. 4 is a drainage of both the first and second control legs 10 and 12, which is a shutdown scenario for the device 6 that has been performed by the second valve manifold 30 in conjunction with the bypass apparatus 48. As such, the bypass apparatus 48 permits the second valve manifold 30 to additionally perform a shutdown operation as a secondary function, and such secondary function is a redundant function of that which is provided by the first valve manifold 16 as its primary function, namely a shutdown.

It thus can be seen that the two valve manifolds 16 and 30 and the hydraulic appliance 52 perform three separate hydraulic functions, i.e., overspeed control provided by the second valve manifold 30, shutdown provided by the first valve manifold 16, and redundant shutdown provided by the second valve manifold 30 via operation of the bypass apparatus 48. The inclusion of the bypass apparatus 48 thus obviates the need to provide a separate valve manifold to perform the redundant shutdown operation by enabling to instead be performed by the second valve manifold 30. Moreover, the hydraulic appliance 52 that incorporates the bypass apparatus 48 is far less expensive than a separate valve manifold, perhaps one tenth the cost thereof.

It thus can be seen that the inclusion of the hydraulic appliance 52 in the hydraulic apparatus 4 reduces the cost of the hydraulic apparatus 4 by obviating the need for a third valve manifold. Additionally, the hydraulic appliance 52 connects directly with the first and second control legs 10 and 12, respectively, and thus reduces the complexity of the fluid connections in the hydraulic apparatus 4. Further, the hydraulic appliance 52 is relatively smaller than a separate valve manifold and the many fluid connections that would be required thereof, which permits the hydraulic apparatus 4 to occupy a reduced space than would be required if a third separate valve manifold were employed. All of the above thus advantageously reduce cost, both in terms of the cost of the components and in terms of the complexity and size of the arrangement, all of which is advantageous. Other advantages will be apparent.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A hydraulic apparatus structured to manage supplying of hydraulic fluid to a device, the hydraulic apparatus comprising:

a first control leg structured to be connected in fluid communication with the device;

a second control leg structured to be connected in fluid communication with the device;

a check valve that is connected in fluid communication between the first control leg and the second control leg, the check valve resisting hydraulic fluid flow in a direction from the first control leg toward the second control leg and permitting hydraulic fluid flow in a direction from the second control leg toward the first control leg;

a bypass apparatus that is connected in fluid communication between the first control leg and the second control leg and that is connected in parallel with the check valve, the bypass apparatus being operable between a first state and a second state, the bypass apparatus in the first state resisting hydraulic fluid flow between the first and second control legs, the bypass apparatus in the second state permitting hydraulic fluid flow between the first and second control legs;

a number of first valves connected in fluid communication with the first control leg, the number of first valves further being connected in fluid communication with a supply of hydraulic fluid that is at a first pressure and with a drain that is at a second pressure, the first pressure being greater than the second pressure, the number of first valves being operable between a first state and a second state;

in the first state of the number of first valves and the first state of the bypass apparatus:

the first control leg being in fluid communication with the supply;

in the second state of the number of first valves and the first state of the bypass apparatus:

the first control leg being in fluid communication with the drain, and the second control leg via the check valve being in fluid communication with the drain;

in the first state of the number of first valves and the second state of the bypass apparatus:

the first control leg being in fluid communication with the supply and being in fluid communication with the second control leg via the bypass apparatus;

in the second state of the number of first valves and the second state of the bypass apparatus the first control leg being in fluid communication with the drain, and the second control leg via the check valve and the bypass apparatus being in fluid id communication with the drain;

a number of second valves connected in fluid communication with the second control leg, the supply, and the drain, the number of second valves being operable between a first state and a second state;

in the first state of the number of second valves and the first state of the bypass apparatus:

the second control leg being in fluid communication with the supply;

in the second state of the number of second valves and the first state of the bypass apparatus:

the second control leg being in fluid communication with the drain;

in the first state of the number of second valves and the second state of the bypass apparatus:

the second control leg being in fluid communication with the supply and being in fluid communication with the first control leg via the bypass apparatus;

in the second state of the number of second valves when the bypass apparatus is in the second state:

the second control leg being in fluid communication with the drain, and the first control leg being in fluid communication via the bypass apparatus with the drain.

2. The hydraulic apparatus of claim 1 wherein the bypass apparatus comprises a number of poppet logic valves.

3. The hydraulic apparatus of claim 2 wherein the bypass apparatus further comprises a number of solenoid valves that are in fluid communication with the number of poppet logic valves.

4. A hydraulic appliance usable in a hydraulic apparatus that is structured to manage supplying of hydraulic fluid to a device, the hydraulic apparatus including a first control leg structured to be connected in fluid communication with the device, a second control leg structured to be connected in fluid communication with the device, a number of first valves connected in fluid communication with the first control leg, the number of first valves further being connected in fluid communication with a supply of hydraulic fluid that is at a first pressure and with a drain that is at a second pressure, the first pressure being greater than the second pressure, the number of first valves being operable between a first state and a second state, in the first state of the number of first valves and the first state of the bypass apparatus, the first control leg being in fluid communication with the supply; in the second state of the number of first valves and the first state of the bypass apparatus, the first control leg being in fluid communication with the drain, and the second control leg via the check valve being in fluid communication with the drain; in the first state of the number of first valves and the second state of the bypass apparatus, the first control leg being in fluid communication with the supply and being in fluid communication with the second control leg via the bypass apparatus; in the second state of the number of first valves and the second state of the bypass apparatus, the first control leg being in fluid communication with the drain, and the second control leg via the check valve and the bypass apparatus being in fluid communication with the drain; a number of second valves connected in fluid communication with the second control leg, the supply, and the drain, the number of second valves being operable between a first state and a second state, in the first state of the number of second valves and the first state of the bypass apparatus, the second control leg being in fluid communication with the supply; in the second state of the number of second valves and the first state of the bypass apparatus, the second control leg being in fluid communication with the drain; in the first state of the number of second valves and the second state of the bypass apparatus, the second control leg being in fluid communication with the supply and being in fluid communication with the first control leg via the bypass apparatus; in the second state of the number of second valves when the bypass apparatus is in the second state, the second control leg being in fluid communication with the drain, and the first control leg being in fluid communication via the bypass apparatus with the drain, the hydraulic appliance comprising:

a check valve that is structured to be connected in fluid communication between the first control leg and the second control leg, the check valve resisting hydraulic fluid flow in a direction from the first control leg toward the second control leg and permitting hydraulic fluid flow in a direction from the second control leg toward the first control leg; and a bypass apparatus that is structured to be connected in fluid communication between the first control leg and the second control leg and that is connected in parallel with the check valve, the bypass apparatus being operable between a first state and a second state, the bypass apparatus in the first state resisting hydraulic fluid flow between the first and second control legs, the bypass apparatus in the second state permitting hydraulic fluid flow between the first and second control legs.

* * * * *